US011407100B1

(12) United States Patent
Dogka

(10) Patent No.: US 11,407,100 B1
(45) Date of Patent: Aug. 9, 2022

(54) DRAIN SCRIBE

(71) Applicant: Denzil Forsythe Dogka, Fort McDowell, AZ (US)

(72) Inventor: Denzil Forsythe Dogka, Fort McDowell, AZ (US)

( * ) Notice: Subject to any disclaimer, the term of this patent is extended or adjusted under 35 U.S.C. 154(b) by 63 days.

(21) Appl. No.: 17/079,250

(22) Filed: Oct. 23, 2020

Related U.S. Application Data

(60) Provisional application No. 62/936,291, filed on Nov. 15, 2019.

(51) Int. Cl.
*B25H 7/00* (2006.01)
*B25H 7/04* (2006.01)

(52) U.S. Cl.
CPC ..... *B25H 7/005* (2013.01); *B25H 7/04* (2013.01)

(58) Field of Classification Search
CPC ..... B25H 7/005; B25H 7/04
See application file for complete search history.

(56) References Cited

U.S. PATENT DOCUMENTS 2,431,100 A * 11/1947 Woods ..... G01B 3/00 269/48
2,677,181 A * 5/1954 Sury ..... B43L 9/04 33/21.3
3,129,512 A * 4/1964 Schiler ..... B25H 7/00 33/21.3
4,277,894 A * 7/1981 Duhe ..... B25H 7/005 33/21.3
4,367,593 A * 1/1983 Whitworth ..... B25H 7/005 33/529
4,553,305 A * 11/1985 Dearman ..... B23K 37/0533 33/21.3
4,718,172 A * 1/1988 Rouse ..... G01B 5/205 33/530
4,793,066 A * 12/1988 Cheng ..... B25H 7/005 33/DIG. 1
5,357,683 A * 10/1994 Trevino ..... B25H 7/00 33/528
5,579,672 A * 12/1996 Findlay ..... B27B 27/04 83/522.11
5,860,220 A * 1/1999 Gerd ..... B25H 7/005 33/529
8,713,811 B2 * 5/2014 Carrell ..... B25H 7/005 33/529
9,021,713 B1 * 5/2015 Pierson ..... G01B 5/24 33/529
2006/0107543 A1 * 5/2006 Smith ..... E04G 21/16 33/562
2013/0276316 A1 * 10/2013 Carrell ..... B25H 7/005 33/290

* cited by examiner

*Primary Examiner* — Yaritza Guadalupe-McCall
(74) *Attorney, Agent, or Firm* — Plager Schack LLP; Mark H. Plager; Kara Verryt

(57) ABSTRACT

A scribe for measuring and marking pipe protrusions on a cabinet panel may include a foot designed to be positioned against a ground surface, the foot sized to accommodate placement of an end of an elongate rail therein; a housing sized to encircle a portion of the elongate rail; a pair of adjustment arms pivotably attached to the housing; a pipe measuring component slidably attached to each of the pair of adjustment arms; and a pipe return alignment protrusion extending from an outer surface of the housing, the pipe return alignment protrusion sized to accommodate an end of a pipe return line therein.

9 Claims, 5 Drawing Sheets

DRAIN SCRIBE

RELATED APPLICATION

This application claims priority to provisional patent application U.S. Ser. No. 62/936,291 filed on Nov. 15, 2019, the entire contents of which is herein incorporated by reference.

BACKGROUND

The embodiments described herein relate generally to construction tools and, more particularly, to a device for precisely transferring pipe protrusion measurements to scribe where cuts need to be marked for cabinet/vanity installation.

Properly installing cabinets/vanities that include plumbing can be difficult and time consuming, because numerous measurements are needed. If the measurements are taken incorrectly, the pipe openings may be cut in the wrong place, which can require possibly cabinet replacement.

Therefore, what is needed is a device that enables a novice, handyman, or cabinet installer to quickly, easily, and accurately transfer pipe protrusion measurements to a cabinet panel using only one measurement.

SUMMARY

Some embodiments of the present disclosure include a scribe for measuring and marking pipe protrusions on a cabinet panel. The scribe may include a foot designed to be positioned against a ground surface, the foot sized to accommodate placement of an end of an elongate rail therein; a housing sized to encircle a portion of the elongate rail; a pair of adjustment arms pivotably attached to the housing; a pipe measuring component slidably attached to each of the pair of adjustment arms; and a pipe return alignment protrusion extending from an outer surface of the housing, the pipe return alignment protrusion sized to accommodate an end of a pipe return line therein.

BRIEF DESCRIPTION OF THE FIGURES

The detailed description of some embodiments of the invention is made below with reference to the accompanying figures, wherein like numerals represent corresponding parts of the figures.

DETAILED DESCRIPTION

Figure 1:
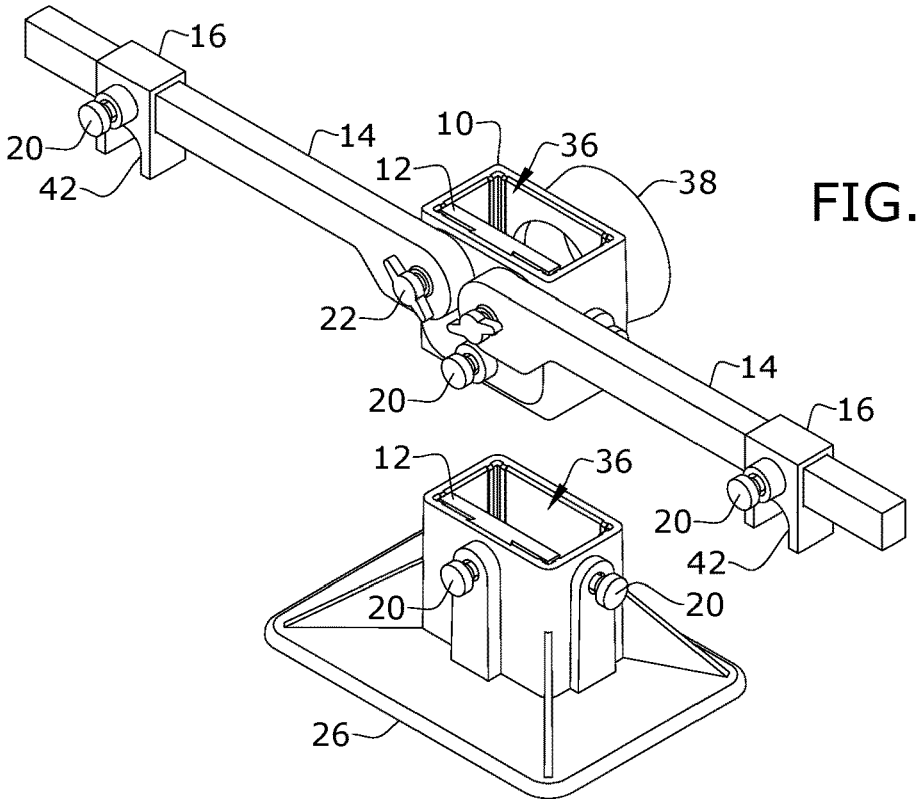
FIG. 1 is a perspective view of one embodiment of the present disclosure.
Figure 2:
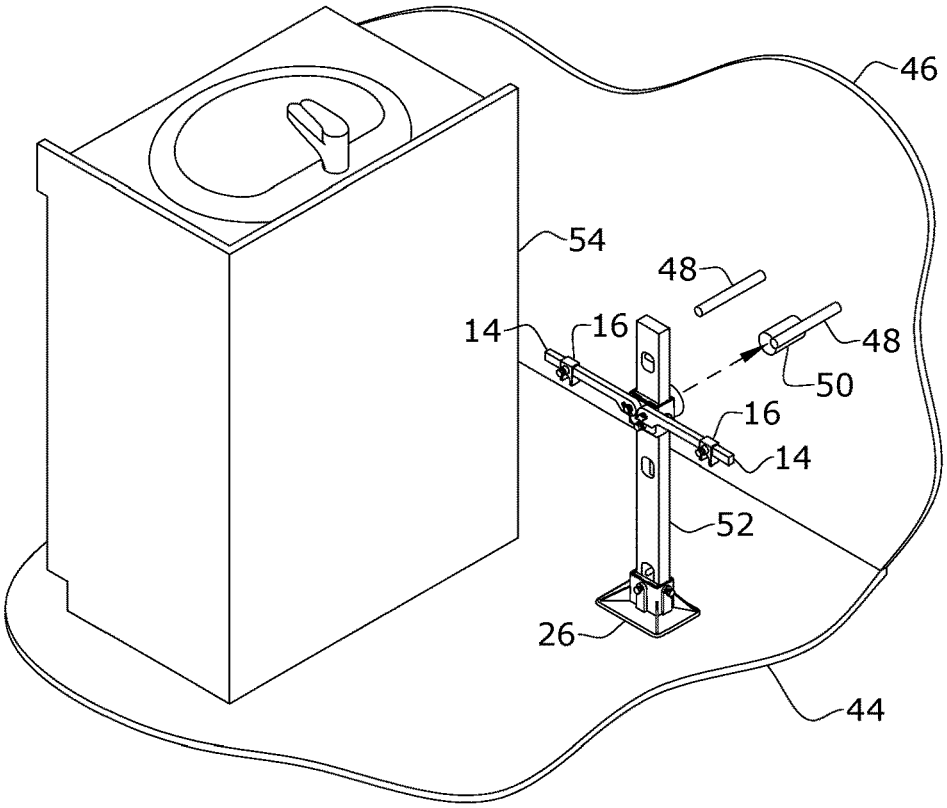
FIG. 2 is a perspective view of one embodiment of the present disclosure, shown in use.
Figure 3:
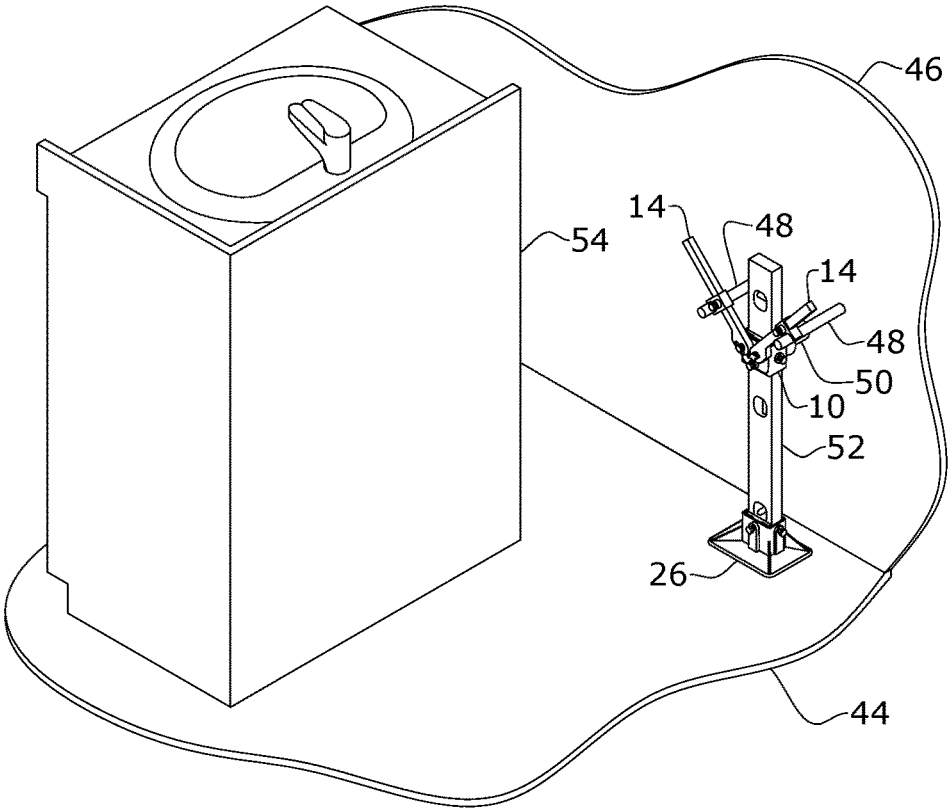
FIG. 3 is a perspective view of one embodiment of the present disclosure, shown in use.
Figure 4:
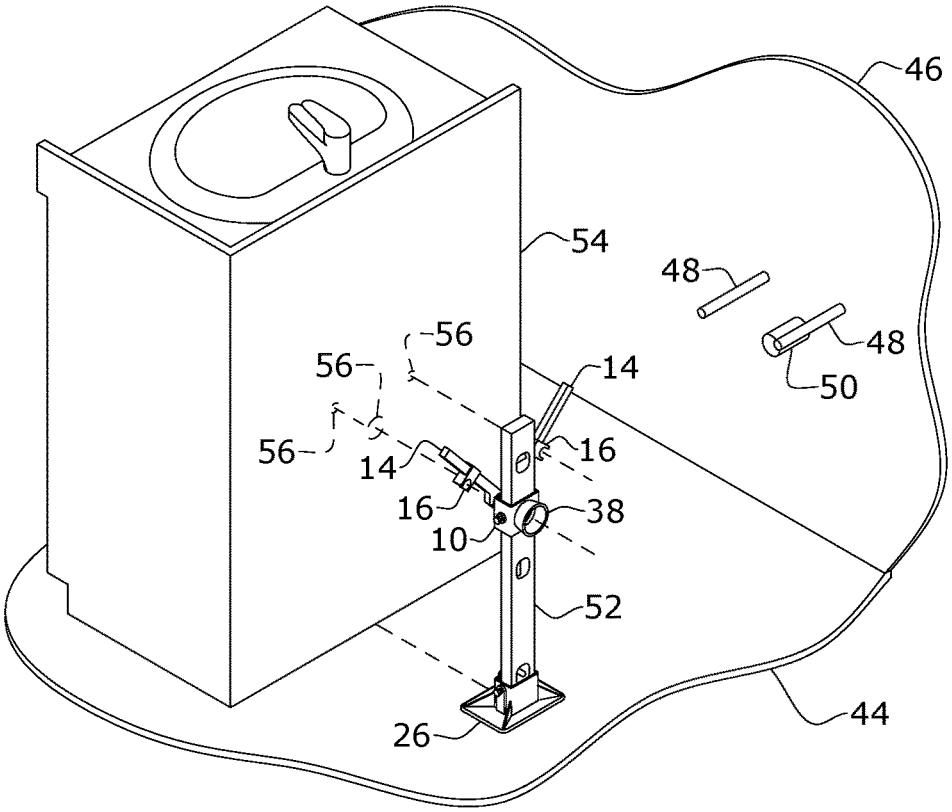
FIG. 4 is a perspective view of one embodiment of the present disclosure, shown in use.

In the following detailed description of the invention, numerous details, examples, and embodiments of the invention are described. However, it will be clear and apparent to one skilled in the art that the invention is not limited to the embodiments set forth and that the invention can be adapted for any of several applications.

The device of the present disclosure may be used as a measurement and marking device for pipe protrusion cutting on cabinet panels and may comprise the following elements. This list of possible constituent elements is intended to be exemplary only, and it is not intended that this list be used to limit the device of the present application to just these elements. Persons having ordinary skill in the art relevant to the present disclosure may understand there to be equivalent elements that may be substituted within the present disclosure without changing the essential function or operation of the device.

The various elements of the present disclosure may be related in the following exemplary fashion. It is not intended to limit the scope or nature of the relationships between the various elements and the following examples are presented as illustrative examples only.

By way of example, and referring to FIGS. 1-9, some embodiments of the invention include a scribe for measuring and marking pipe protrusions on a cabinet panel 54, the scribe comprising a foot 26 designed to be positioned against a ground surface 44, the foot 26 sized to accommodate placement of an elongate rail, such as a level 54, therein; a housing 10 sized to encircle a portion of the elongate rail; a pair of adjustment arms 14 pivotably attached to the housing 10; a pipe measuring component 16 slidably attached to each of the pair of adjustment arms 14; and a pipe return alignment protrusion 38 extending from an outer surface of the housing 10.

As shown in the Figures, the foot 26 may comprise a base designed to be positioned against the ground surface 44 and a protrusion extending upwards from the base, wherein the protrusion includes a rail opening 36 sized to accommodate an end portion of the elongate rail therein. In some embodiments, the protrusion may include a removable shim 12 positioned within the rail opening 36, such that the protrusion can accommodate elongate rails of varying size. The protrusion may also comprise at least one insert opening 28 into which a fastener, such as a thumb screw 20, may be inserted, wherein the thumb screw 20 is designed to place pressure on the shim 12 or the elongate rail itself to secure the elongate rail within the foot 26. In some embodiments, a threaded insert 18 may be positioned within the insert opening 28, such that the threads on the thumb screw 20 may engaged therewith. In other embodiments, the insert opening 28 may have built-in threads.

As also shown in the Figures, the housing 10 may comprise a rail opening 36 extending therethrough, such that the housing 10 may slide along a length of the elongate rail. For example, the housing 10 may comprise a front wall, two side wall, and a rear wall, together designed to encircle the elongate rail, wherein the front wall is opposite the rear wall and the two side walls attach the front wall to the rear wall. At least one of the walls may include a securing device built therein, wherein the securing device is designed to secure the housing 10 at a desired height along a length of the elongate rail. For example, and as shown in the Figures, at least one of the side walls may include a threaded insert 18 positioned within an insert opening 28, wherein the threaded insert 18 is designed to engage with threads on a fastener, such as a thumb screw 20, such that the thumb screw 20 may screw into the opening 28 and put pressure on the elongate rail to securing the housing 10 in place. Thus, the securing device may be similar in structure to the fasteners on the foot 26. In some embodiments, a shim 12 may be positioned within the rail opening 36 and, thus, the housing 10 may be used on various sized elongate rails. The shim 12 may have the same or similar structure as the shim 12 optionally positioned within the foot 26.

As described above, the housing 10 may have a pair of adjustment arms 14 pivotably attached thereto, wherein the pair of adjustment arms 14 extends from the housing 10 in opposite directions. Each of the adjustment arms 14 may have a substantially elongate shape. The adjustment arms 14 may be attached to the housing 10 using any known or suitable fasteners allowing for the pivoting and securing of the adjustment arms 14 at an angle with respect to the housing 10. For example, as shown in the Figures, each adjustment arm 14 may be pivotably attached to the front wall of the housing 10. Specifically, an end of the adjustment arm 14 proximate to the housing may comprise a fastener orifice extending therethrough, wherein the fastener orifice is sized to accommodate passage of a fastener therethrough, wherein the fastener passes through the adjustment arm 14 and engages with an insert opening 28 in the front surface of the housing 10. In a particular embodiment, the fastener may comprise a long thumb screw 22, wherein the orifices in the adjustment arms 14 have a threaded insert 18 positioned therein, the long thumb screw 22 designed to engage with the threads on the threaded insert 18 and extend through the adjustment arms 14 into insert openings 28 on the front wall of the housing 10, wherein at least one sealing washer 24, such as a pair of sealing washers 24, may be positioned between each adjustment arm 14 and the housing 10. As such, the angle of the adjustment arm 14 may be adjusted by loosening the long thumb screw 22, pivoting the adjustment arm 14 to the desired angle, and tightening the long thumb screw 22.

Figure 7:
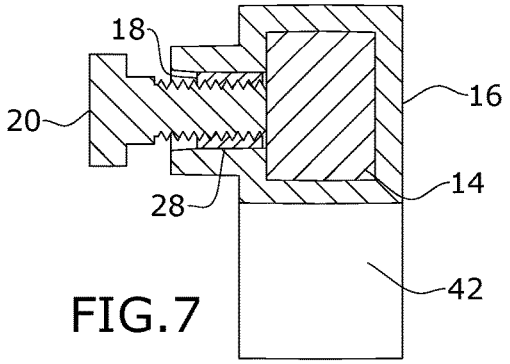
FIG. 7 is a section view of one embodiment of the present disclosure, taken along line 7-7 in FIG. 6.
Figure 8:
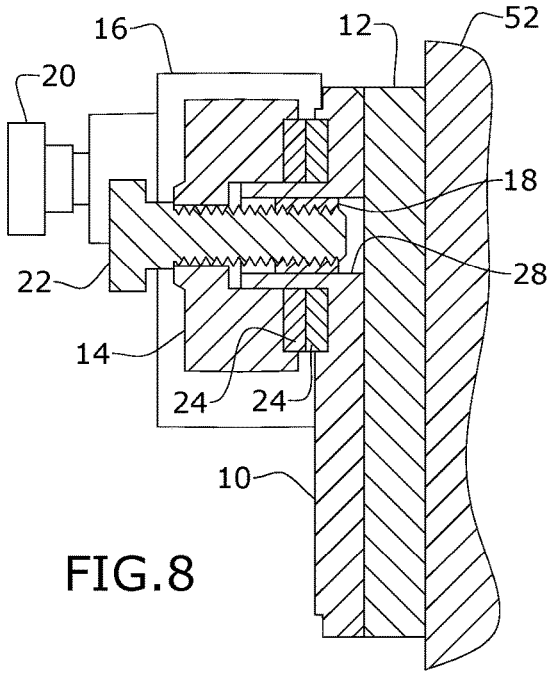
FIG. 8 is a section view of one embodiment of the present disclosure, taken along line 8-8 in FIG. 6.
Figure 9:
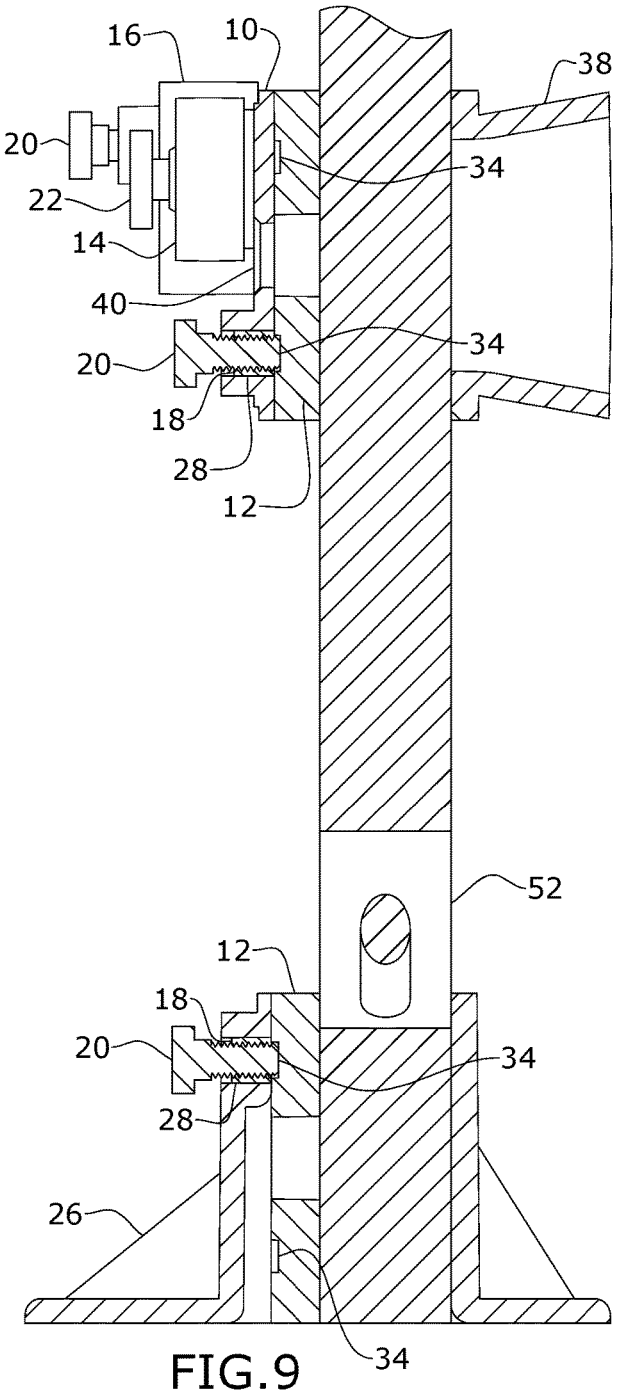
FIG. 9 is a section view of one embodiment of the present disclosure, taken along line 9-9 in FIG. 6.

In some embodiments, each adjustment arm 14 may have a pipe measurement device 16 slidably mounted thereto. For example, and as shown in the Figures, the pipe measuring device 16 may comprise a sliding block with a rounded notch 42 cut therein, the notch 42 being substantially semi-circular in shape and have a diameter that closely approximates a diameter of a piping supply line 48 to be measured. The sliding block may also include a channel through which the adjustment arm 14 extends, such that the sliding block may slide along a length of the adjustment arm 14. A fastener may be designed to secure the sliding block at its desired location along a length of the adjustment arm 14. In some embodiments, the fastener may comprise a thumb screw 20 designed to extend through an insert opening 28 in the sliding block and abut the adjustment arm 14, as shown in FIG. 7. In some embodiments, the insert opening 28 includes a threaded insert 18 positioned therein. Alternatively, an interior of the insert opening 28 may include built-in threads.

Embodiments of the housing 10 may also comprise a pipe return alignment protrusion 38 extending from the rear wall thereof. The pipe return alignment protrusion 38 may, in some embodiments, have a diameter that tapers from a largest diameter distal from the rear wall to a smallest diameter proximate to the rear wall of the housing 10. In any case, the diameter of the protrusion 38 may be sufficient for accommodating a piping return line 50 therein. A front wall of the housing 10 may also comprise a pipe return alignment viewing opening 40 extending therethrough, such that a user may be able to visualize the piping return line 50 from a front side of the housing 10.

Figure 5:
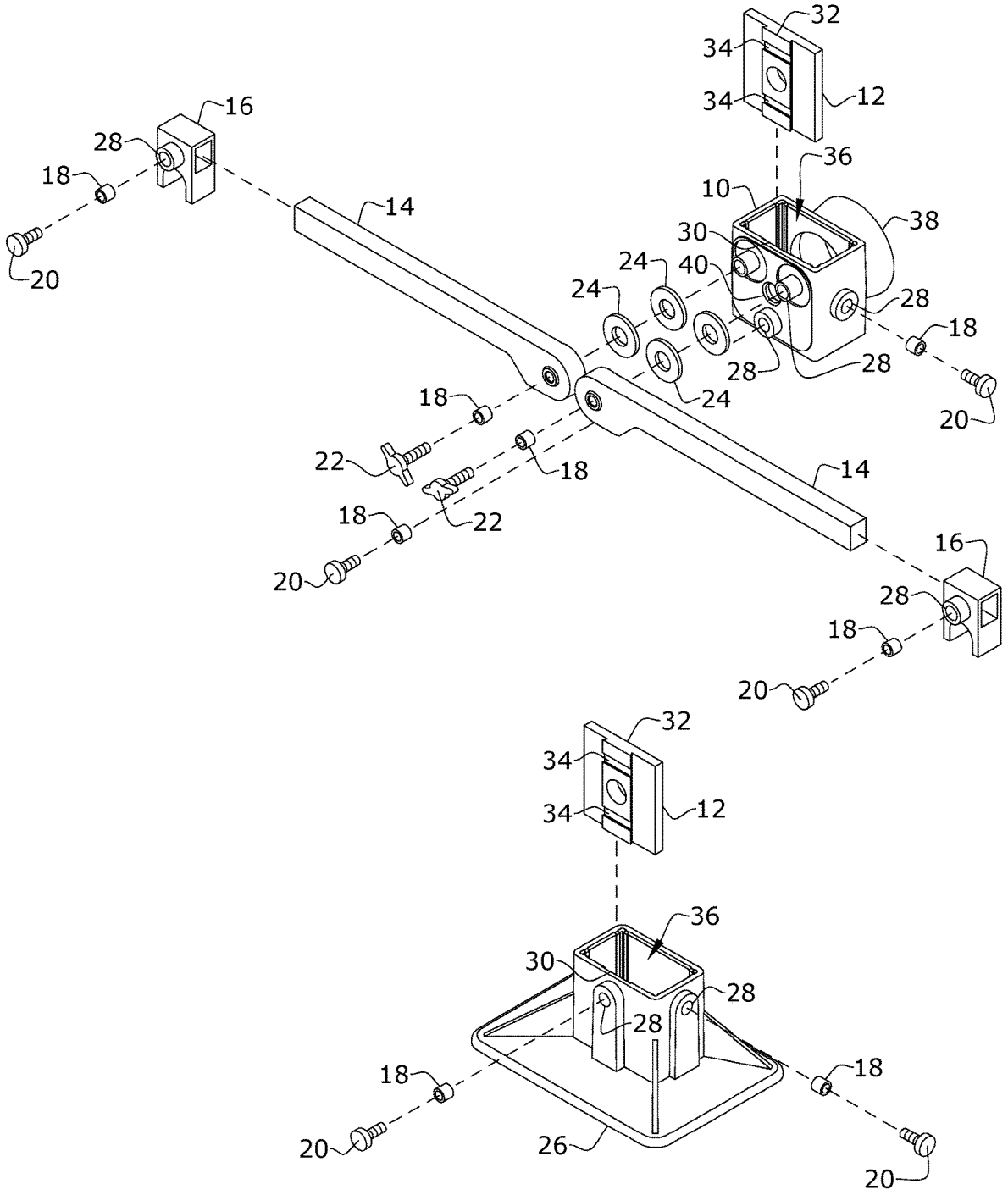
FIG. 5 is an exploded view of one embodiment of the present disclosure.
Figure 6:
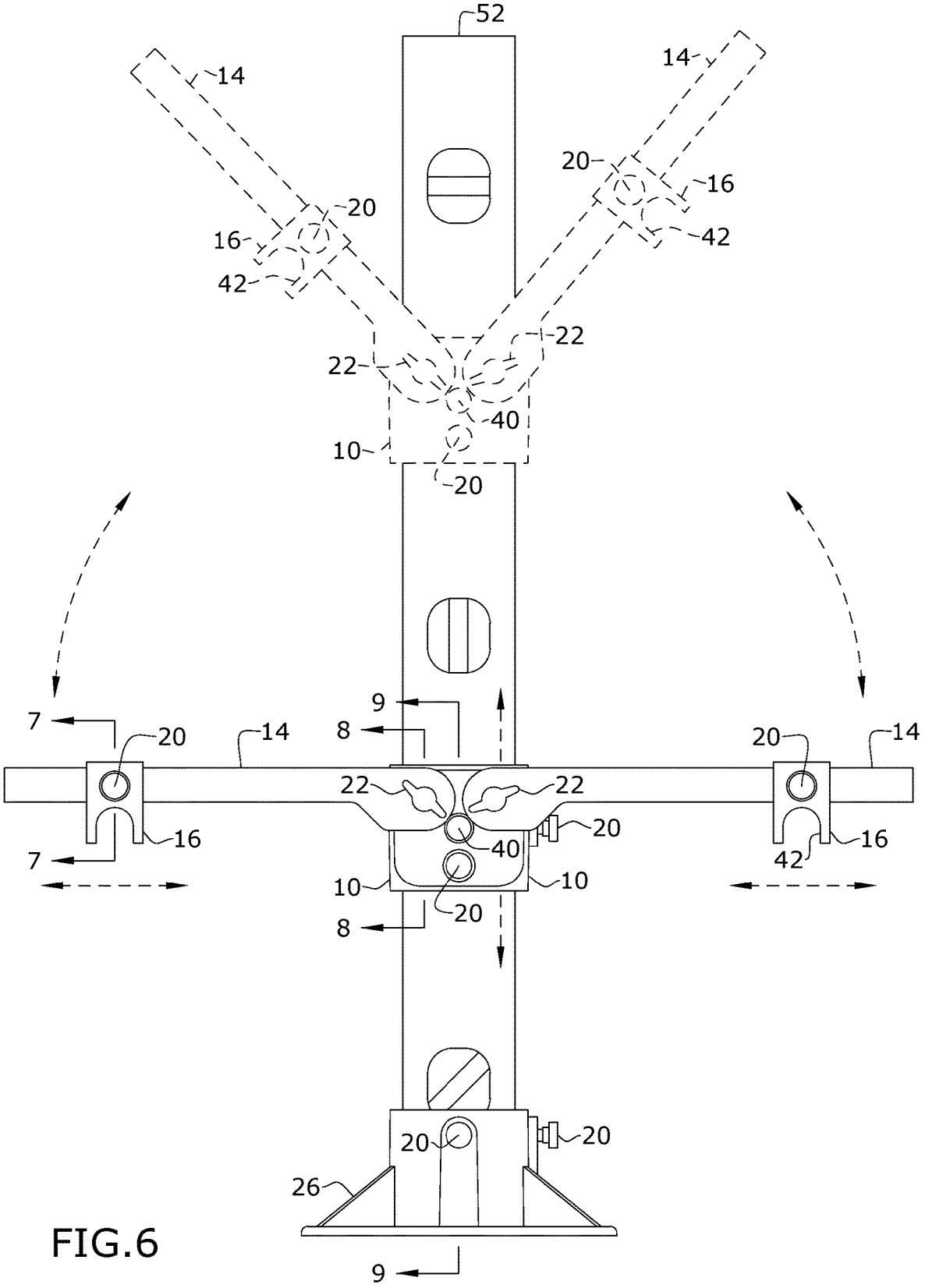
FIG. 6 is a front view of one embodiment of the present disclosure.

As discussed above, each of the rail opening 36 in the foot 26 and in the housing 10 may have a shim 12 positioned therein. As shown in FIG. 5, the shim 12 may have a substantially rectangular or square shape with a pair of thumb screw slots 34 extending into a front surface thereof, the thumb screw slots 34 designed to accommodate an end of the thumb screws 20 therein. The shim may also comprise a male shim tab 32 extending slightly outward from a front surface thereof, wherein the male shim tab 32 may be designed and positioned to engage with a female shim slot 30 on an interior surface of the housing 10 and the foot protrusion to ensure proper placement of the shim 12 within the rail openings 36.

In some embodiments, the device may further comprise an elongate rail, such as a bubble level 52 engaged with the foot 26 and the housing 10. Alternatively, a user may use a standalone level.

To use the scribe of the present disclosure, an elongate rail may be placed into the rail opening 36 in the foot 26 and the housing 10 may be slide onto the elongate rail. The pipe alignment protrusion 38 on the housing 10 may be aligned with the pipe return line 50 extending from, for example, a wall 46 in a kitchen or bathroom. The housing 10 may be locked into place on the elongate rail at the required position using, for example, the thumb screw 20, such that the pipe alignment protrusion 38 is aligned with the pipe return line 50. The angle of each adjustment arm 14 may then be adjusted and the pipe measuring component 16 may be adjusted along the length of the adjustment arm 14 to align with the piping supply line 48 and locked into place using, for example, the thumb screws 20. The device may then be moved away from the wall 46. Meanwhile, the drain pipe horizontal center point from the edge of the cabinet may be measured and marked on the back panel 54. The scribe may then be placed on the center mark on the back panel 54, and the piping supply line 48 and pipe return line 50 measurements may be scribed onto the back panel 54 using the rounded notch 42 and the pipe return alignment protrusion 38, respectively, creating transcribed pipe locations 56 on the back panel 54.

While the above describes using the scribe for plumbing and cabinet installation purposes, the scribe may also be used to mark and transfer pipe protrusions on drywall, mark and cut electrical boxes, recess lighting, appliance outlet box openings, and the like.

The above-described embodiments of the invention are presented for purposes of illustration and not of limitation. While these embodiments of the invention have been described with reference to numerous specific details, one of ordinary skill in the art will recognize that the invention can be embodied in other specific forms without departing from the spirit of the invention. Thus, one of ordinary skill in the art would understand that the invention is not to be limited by the foregoing illustrative details, but rather is to be defined by the appended claims.

What is claimed is:

1. A scribe for measuring and marking pipe protrusions on a cabinet panel, the scribe comprising:

a foot designed to be positioned against a ground surface, the foot sized to accommodate placement of an end of an elongate rail therein, wherein the foot comprises:

a base designed to be positioned against the ground surface and a protrusion extending upwards from the base; and the protrusion includes a rail opening sized to accommodate the end of the elongate rail;

a housing sized to encircle a portion of the elongate rail, wherein:

the housing comprises a front wall, two side walls, and a rear wall, together designed to define a rail opening extending through the housing, the rail opening sized to accommodate the elongate rail; and at least one member selected from the group consisting of the front wall, the two side walls, and the rear wall comprises at least one fastener extending therethrough, the at least one fastener sized and positioned to removably secure the housing to the elongate rail;

a pair of adjustment arms pivotably attached to the housing;

a pipe measuring component slidably attached to each of the pair of adjustment arms; and a pipe return alignment protrusion extending from an outer surface of the housing, the pipe return alignment protrusion sized to accommodate an end of a pipe return line therein.

2. The scribe of claim 1, wherein the protrusion comprises at least one fastener extending therethrough, the at least one fastener sized and positioned to removably secure the protrusion to the elongate rail.

3. The scribe of claim 2, wherein:

the protrusion includes at least one insert opening extending therethrough; and the at least one fastener comprises a thumb screw designed to engage with and pass through the insert opening.

4. The scribe of claim 1, wherein each adjustment arm of the pair of adjustment arms is pivotably attached to the front wall of the housing.

5. The scribe of claim 1, wherein the pipe measuring component comprises a sliding block slidably engaged with the adjustment arm, the sliding blocking having a rounded notch cut therein, the rounded notch being substantially semi-circular in shape and having a diameter that closely approximates a diameter of a piping supply line to be measured.

6. The scribe of claim 5, further comprising a fastener extending through the pipe measuring component and abutting the adjustment arm, wherein the fastener is designed to secure the pipe measuring component at a desired location along a length of the adjustment arm.

7. The scribe of claim 1, further comprising:

a first shim positioned within the foot; and a second shim positioned within the housing.

8. The scribe of claim 7, further comprising an elongate rail positioned within the foot and engaged with the housing.

9. A scribe for measuring and marking pipe protrusions on a cabinet panel, the scribe comprising:

a foot designed to be positioned against a ground surface, the foot sized to accommodate placement of an end of an elongate rail therein;

a housing sized to encircle a portion of the elongate rail;

a pair of adjustment arms pivotably attached to the housing;

a pipe measuring component slidably attached to each of the pair of adjustment arms, the pipe measuring component comprising a sliding block slidably engaged with the adjustment arm, the sliding blocking having a rounded notch cut therein, the rounded notch being substantially semi-circular in shape and having a diameter that closely approximates a diameter of a piping supply line to be measured; and a pipe return alignment protrusion extending from an outer surface of the housing, the pipe return alignment protrusion sized to accommodate an end of a pipe return line therein.

* * * * *